United States Patent [19]

Beltrame et al.

[11] Patent Number: 4,541,505

[45] Date of Patent: Sep. 17, 1985

[54] ACOUSTIC UNIT BASE FOR ELECTROPNEUMATIC HORNS

[75] Inventors: Leonardo Beltrame, Via Breganzola 11, Arcugnano, Vicenza; Attilio Granziera, Camisano Vicentino, both of Italy

[73] Assignee: Leonardo Beltrame, Arcugnano, Italy; a part interest

[21] Appl. No.: 517,901

[22] Filed: Jul. 28, 1983

[30] Foreign Application Priority Data

Aug. 27, 1982 [IL] Israel ..... 23013 A/82

[51] Int. Cl.[4] ..... G10K 11/00

[52] U.S. Cl. ..... 181/179; 340/388; 116/142 FP

[58] Field of Search ..... 181/179, 189, 190, 192, 181/177, 198; 340/388, 391, 404; 116/142 FP, 142 FV, 142 R, 59

[56] References Cited

U.S. PATENT DOCUMENTS 4,252,077 2/1981 Frigo ..... 116/142 FP 4,401,049 8/1983 Bevillard ..... 116/59 X

*Primary Examiner*—L. T. Hix

*Assistant Examiner*—Brian W. Brown

*Attorney, Agent, or Firm*—Diller, Ramik & Wight

[57] ABSTRACT

An improved acoustic unit base for electropneumatic horns, of the type comprising a main body peripherally seamed to an end piece with a diaphragm therebetween. Said main body is formed by connecting together a first and a second member of deep-drawn sheet metal, the first comprising a central hole and the second forming a cylindrical seat for receiving a bush with a lipped opening which rests on the diaphragm.

13 Claims, 5 Drawing Figures

ACOUSTIC UNIT BASE FOR ELECTROPNEUMATIC HORNS

Electropneumatically operated acoustic units are known constituted structurally by a die-cast body which defines a chamber closed by an approximately circular diaphragm, and to which an exponential horn is fitted.

The diaphragm is constrained peripherally to the body by an end piece, for example by seaming, and rests by way of a central part on the base of a conical bush, in direct communication with the exponential horn.

Means positioned for example on the end piece can also be provided for adjusting the diaphragm tension. The assembly formed from the aforesaid elements to which the exponential horn is fitted is commonly known as a base.

However, the presence of the die-cast body on the one hand leads to high production costs due to the various machining operations involved in the subsequent finish, and on the other hand leads to a certain difficulty in assembling the various elements.

In this respect, the die-cast pieces must firstly be trimmed, before being assembled, in order to remove the formation residues from the casting, and to perfectly adapt it to the other components. In order to obviate the aforesaid drawbacks, units have now been designed in which the body and central bush of the base are of plastics construction and are fixed to the remaining parts by additional metal connecting elements.

In this case, the die-castings are dispensed with, but applicational limitations arise because of dimensional changes in the plastics-moulded material if the temperature varies through a wide range, so causing the tone setting of the diaphragm to change.

Another defect of known bases is that the bushes into which the horns are inserted and the air feed connector are received from the top of the body, making it necessary to invert the piece and thus lose time in assembling the horn. This requirement means that automatic machines either cannot be used or are more difficult to use in assembling said acoustic unit bases.

The object of the present invention is to obviate the aforesaid problems of manufacturing and assembly costs by providing a type of acoustic unit base which allows automatic machines to be used. This object is attained according to the present invention by an improved acoustic unit base for electropneumatic horns, of the type comprising a main body peripherally seamed to an end piece with a diaphragm therebetween, characterised in that said main body is formed by connecting together a first and a second member of deep-drawn sheet metal, the first comprising a central hole and the second forming a cylindrical seat for receiving a bush with a lip aperture which rests on the diaphragm.

Figures 1, 2:
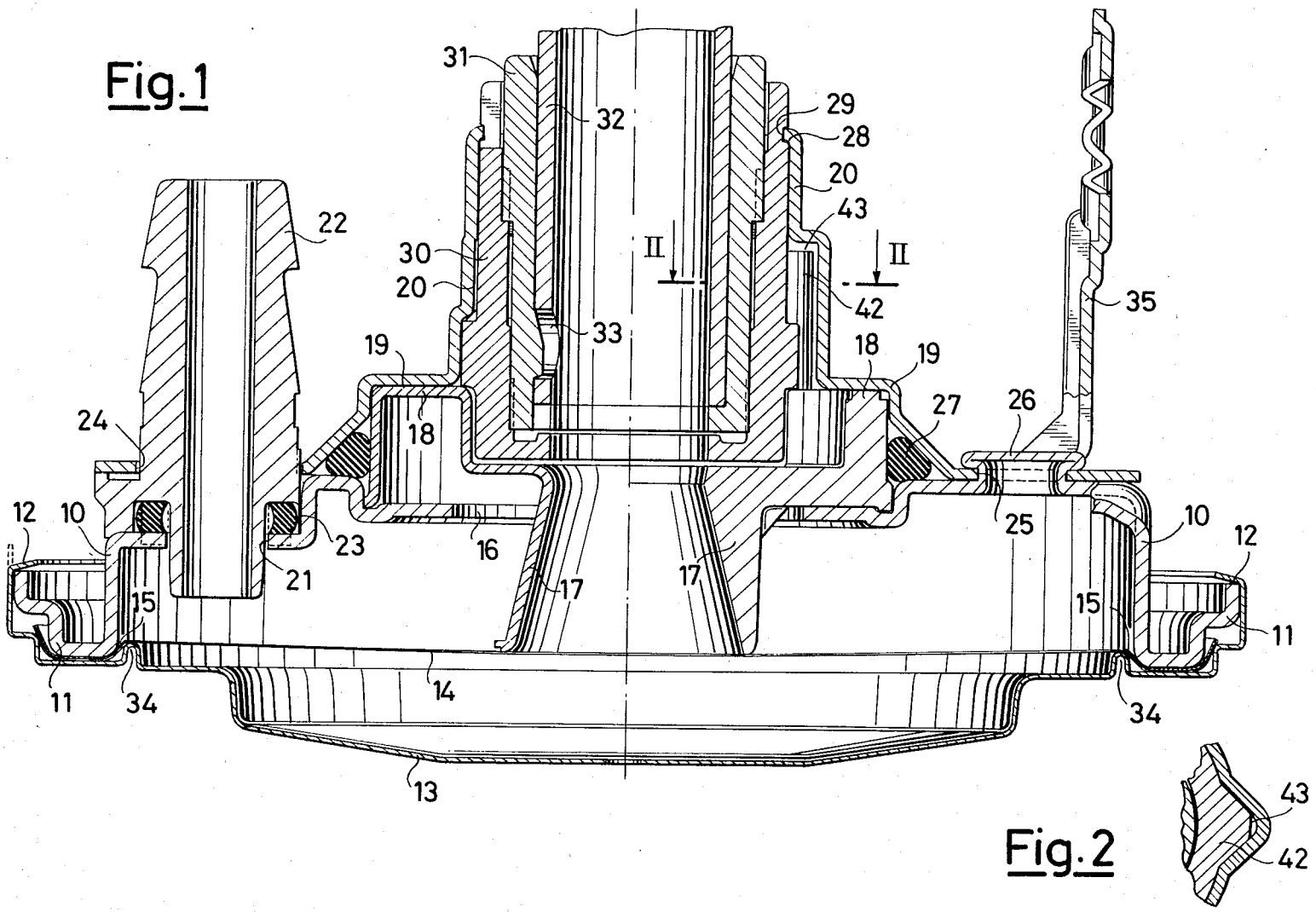
Figure 3:
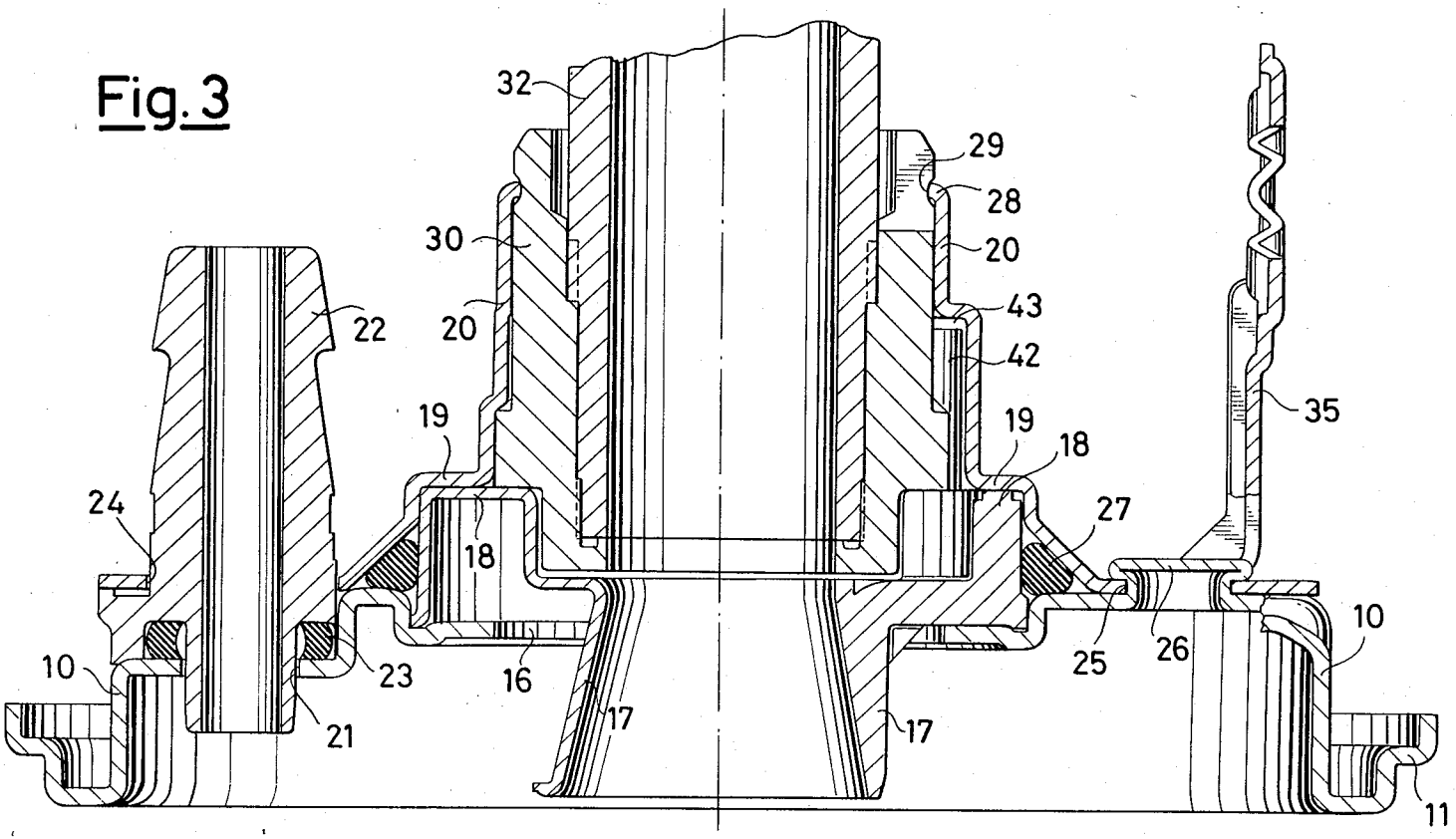
Figure 4:
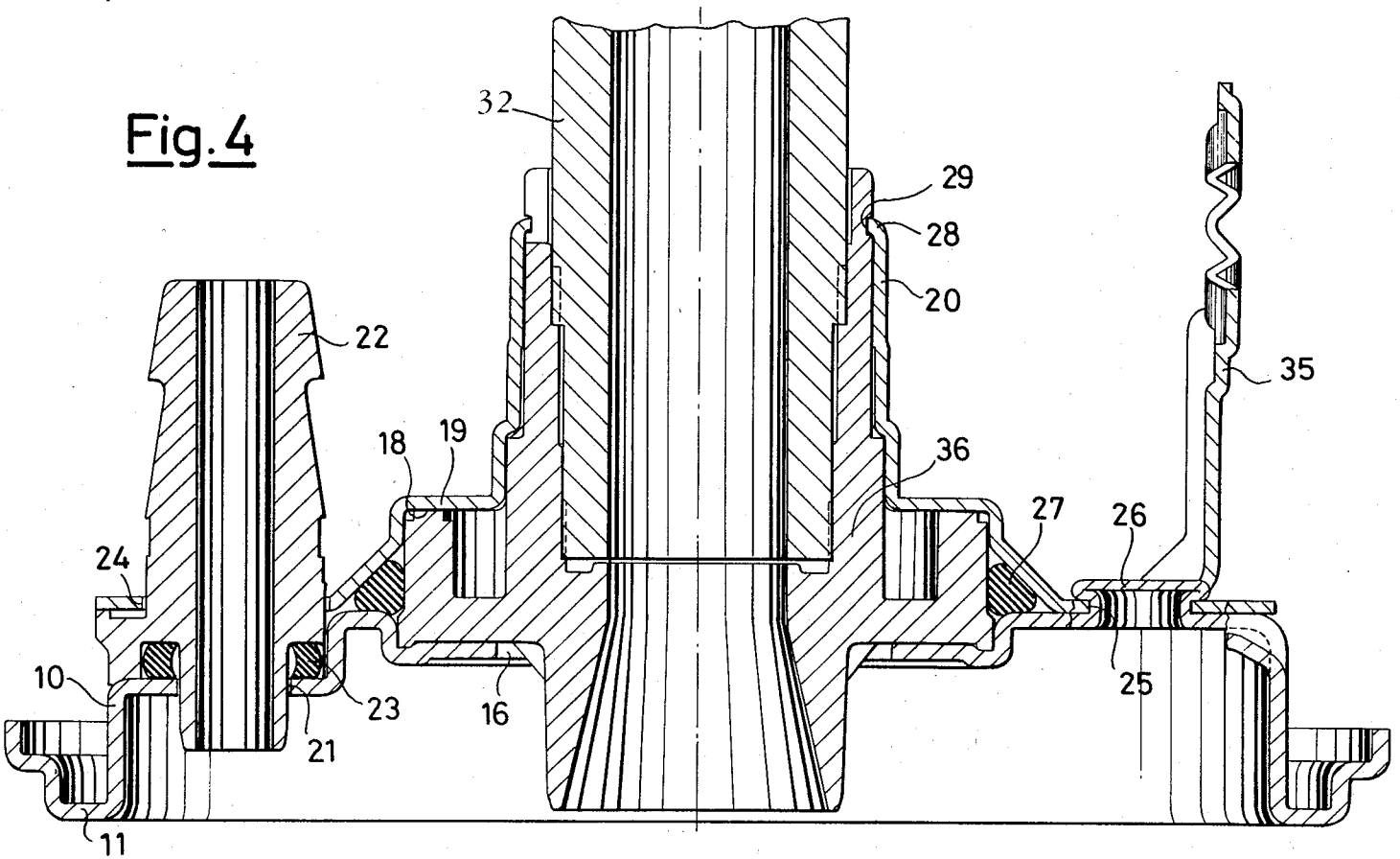
Figure 5:
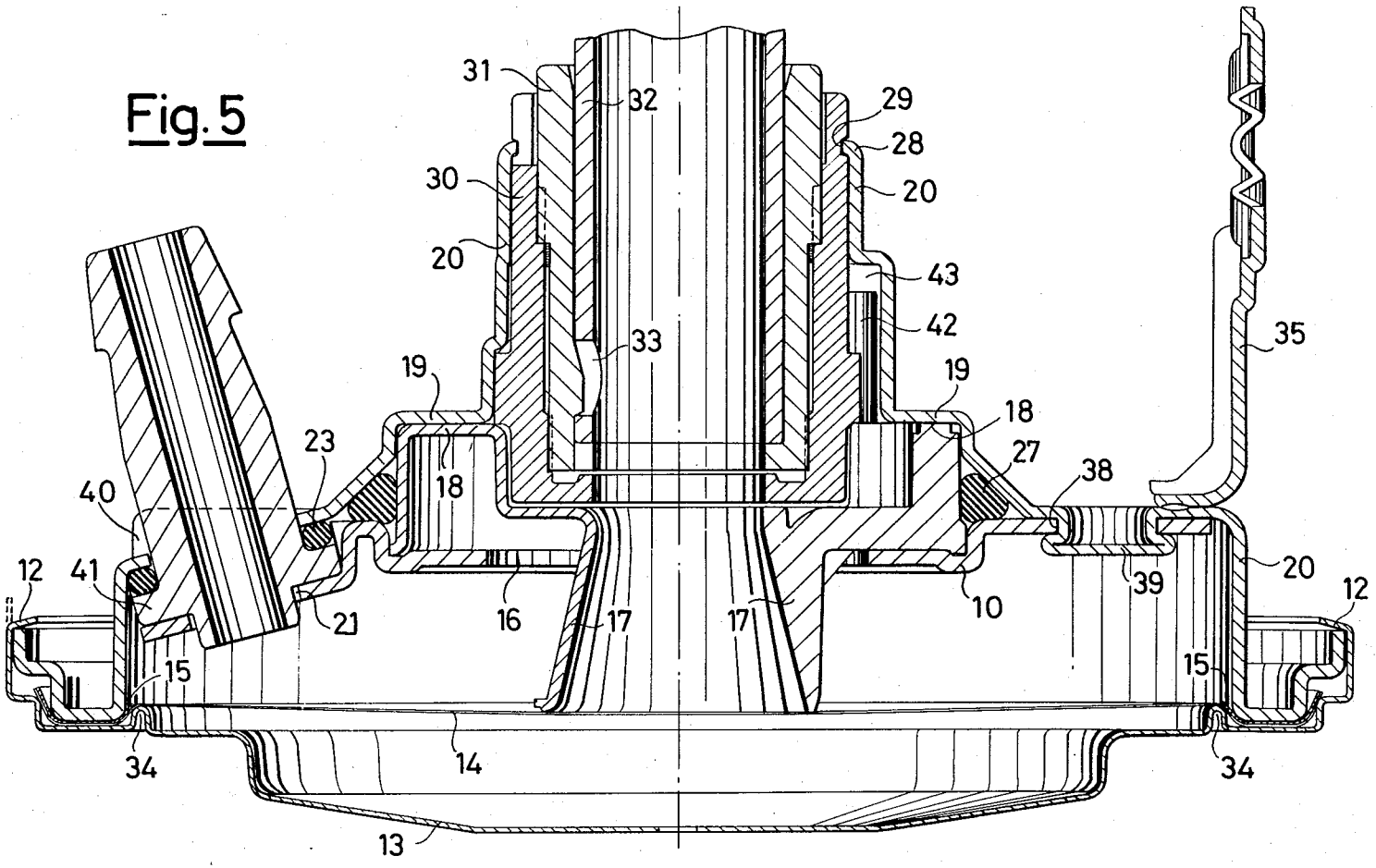

The structural and operational characteristics of the present invention will be more apparent from the accompanying diagrammatic drawings, in which:

FIG. 1 is an axial longitudinal section through an acoustic unit base according to the invention, FIG. 2 is a sectional detail of FIG. 1 on the line II—II, FIGS. 3, 4, 5 are views of other embodiments of acoustic unit base analogous to FIG. 1, which implement the same inventive concept.

With reference to FIG. 1, a base according to the invention comprises a first member 10 of cold deep-drawn sheet metal having its perimetral edge 11 suitably bent and interacting with edges 12 of a sheet metal end piece 13 for locking a diaphragm 14 and a relative gasket 15.

The member 10 centrally comprises a hole 16 through which there passes a sheet metal conical bush 17 having an annular rim 18 of inverted U cross-section, which rests against a terminal stepped portion 19 of a second sleeve-shaped member 20.

The first member 10 also comprises a first hole 21 into which an air feed connector 22 fitted with a gasket 23 is inserted and locked in a second hole 24 provided in the sleeve 20. The sleeve 20 comprises holes 25 into which are inserted deep-drawn portions 26 of the member 10, to be subsequently upset. A second gasket 27 is positioned between portions of the sleeve 20, first member 10 and bush 17. A bent edge 28 of the sleeve 20 engages in an annular cavity 29 of a second bush 30 locked to a counter-bush 31 which retains the terminal part 32 of a metal horn suitably fixed at 33. The end piece 13 is also provided with deep-drawn portions 34, which vary the tension in the diaphragm 14 according to their extent of accentuation.

A bracket 35 is formed directly from the second member 20, for fixing the base in a working position.

In assembling the base, automatic machines carry out three sequential assembly operations.

A first machine automatically mounts the gasket 23 on to the connector 22 to form a first sub-unit.

A second machine automatically mounts the gasket 27 on to the conical bush 17, to form a second sub-unit.

A third machine executes the following operations in succession:

The bush 30 is inserted into the sleeve 20 and remains constrained axially to said sleeve by the engagement of the edge 28 of the sleeve in the annular cavity 29 of the bush.

Relative rotation is prevented by the engagement between teeth 42 formed on the bush 30 and seats 43 in the sleeve 20 (FIG. 2).

After fitting a gasket 27, the bush 17 is inserted so that its annular rim 18 abuts against the step 19 of the sleeve 20.

The connector 22, fitted with the gasket 23, is then positioned in the second orientated hole 24 of the sleeve 20. At this point the member 10 is positioned, and locks all the parts heretofore described by upsetting the drawn portions 26 in the relative holes 25.

A base is thus obtained which by means of an automatic or manual inverting operation is inserted into the end piece 13 into which a diaphragm 14 and gasket 15 have been previously inserted.

The edges 12 are bent over the edge 10 to form a reliable joint. The advantage of being able to assemble the pieces in rapid succesion in this manner using automatic machines and just a few manual operations is apparent.

The bush 17 shown in FIG. 1 is of moulded plastics construction, but because of its small size it does not present the dimensional variation problems described in the introduction.

The base obtained in this manner is mounted with the bore of the bush 30 over the outside of the counter-bush 31, which has been previously mounted on the metal horn 32 and fixed to it at 33. A simple rotowelding operation is used to join the base, constituted by the various elements heretofore described, to the exponential horn 32 fixed to the counter-bush 31, to obtain an acoustic unit for pneumatic horns.

FIG. 3 shows an alternative embodiment of the invention shown in FIG. 1.

The acoustic horn 32 is of plastics construction.

In this case, the counter-bush 31 is dispensed with because the terminal part of said horn can now be rotowelded in the manner of the counter-bush 31, so joining it to the bush 30.

FIG. 4 shows a further embodiment of the invention.

The first bush 17 and the second bush 30 are formed in a single piece 36 which is joined to the terminal part of a plastics horn 32 by simple rotowelding.

FIG. 5 shows a further embodiment of the invention.

The first member 10 comprises holes 38 arranged to receive relative deep-drawn portions 39 provided on the second member 20.

The feed connector 22 is fixed on a suitable seat 40 of the member 20 in a position inclined to the preceding embodiment of FIG. 1, the gasket 23 being lodged between a flange 41 provided on said connector 22, and the second member 20.

This position facilitates the connection of the connector 22 to the compressed air hose.

FIG. 5 also shows the fixing bracket 35 formed separately from the sleeve 20, and connected to it by welding.

In the embodiment of the invention shown in FIG. 5 the end piece 13 has its edges 12 crimped or seamed to the second member 20, as indicated by the phantom and solid lines associated with the edges 12 in FIG. 5.

These further illustrated embodiments obviously implement the same inventive concept.

Further modifications can be made to the embodiment without leaving the scope of the invention.

We claim:

1. An improved acoustic unit base for electropneumatic horns comprising a main body peripherally seamed to an end piece with a diaphragm therebetween, said main body being formed by a first and a second member of deep-drawn sheet metal, said first member comprising a peripheral portion defining a central hole and said second member forming a cylindrical seat, said peripheral portion and cylindrical seat defining a cavity therebetween, a bush having a lip projecting through said central hole and resting on the diaphragm, and said bush further including a portion clampingly retained in said cavity between said peripheral portion and said cylindrical seat.

2. An acoustic unit base as claimed in claim 1, characterised in that said first member comprises edges seamed to the end piece.

3. An acoustic unit base as claimed in claim 1, characterised in that said second member comprises edges seamed to the end piece.

4. An acoustic unit base as claimed in claim 1, characterised in that the end edges of the second member together with portions of the bush retain a second bush arranged to receive the end of a horn.

5. An acoustic unit base as claimed in claim 4, characterised in that a counter-bush which receives the end of a horn is connected to the second bush.

6. An acoustic unit base as claimed in claim 4, characterised in that a tooth is provided on the second bush along one of its generating lines, and is inserted into a corresponding seat provided in the second member.

7. An acoustic unit base as claimed in claim 1, characterised in that the first and second members are kept connected together by a series of deep-drawn portions provided on one said member and upset in relative holes provided in the other said member.

8. An acoustic unit base as claimed in claim 1, characterised in that deep-drawn portions are provided on the end piece in order to tension the diaphragm.

9. An acoustic unit base as claimed in claim 1, characterised in that portions of the first and second members retain a compressed air feed connector positioned in seats and holes provided in said two members.

10. An acoustic unit base as claimed in claim 1, characterised in that a bracket for fixing said unit in its working position is connected to the second member.

11. An improved acoustic unit base for electropneumatic horns comprising a main body peripherally seamed to an end piece with a diaphragm therebetween, said main body being formed by a first and second member, said first member comprising a peripheral portion defining a central hole and said second member forming a cylindrical seat, said peripheral portion and cylindrical seat defining a cavity therebetween, a bush having a lip projecting through said central hole and resting on the diaphragm, and said bush further including a portion clampingly retained in said cavity between said peripheral portion and said cylindrical seat.

12. An acoustic unit base as claimed in claim 11, characterised by said bush portion being an annular rim.

13. An acoustic unit base as claimed in claim 12, characterised in that said cavity is a generally annular seat within which is located and seated said annular rim.

* * * * *

UNITED STATES PATENT AND TRADEMARK OFFICE

CERTIFICATE OF CORRECTION

PATENT NO. : 4,541,505

DATED : September 17, 1985

INVENTOR(S) : Leonardo BELTRAME and Attilio GRANZIERA

It is certified that error appears in the above-identified patent and that said Letters Patent is hereby corrected as shown below:

On the title page:

In the "Heading" under the caption "Foreign Application Priority Data":

"Aug. 27, 1982 [IL] Israel..... 23013A/82"

should read:

-- Aug. 27, 1982 [IL] Italy..... 23013A/82 --.

Signed and Sealed this

Fourteenth Day of January 1986

[SEAL]

Attest:

DONALD J. QUIGG

Attesting Officer

Commissioner of Patents and Trademarks